US011143411B2

(12) United States Patent
Kim et al.

(10) Patent No.: US 11,143,411 B2
(45) Date of Patent: Oct. 12, 2021

(54) COOKING APPLIANCE

(71) Applicant: Samsung Electronics Co., Ltd, Suwon-si (KR)

(72) Inventors: Yeong Hyeok Kim, Suwon-si (KR); Sang Jun Park, Suwon-si (KR); Sang Ho Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 148 days.

(21) Appl. No.: 16/586,738

(22) Filed: Sep. 27, 2019

(65) Prior Publication Data

US 2020/0103119 A1 Apr. 2, 2020

(30) Foreign Application Priority Data

Sep. 27, 2018 (KR) ..... 10-2018-0114916

(51) Int. Cl.
*F24C 3/12* (2006.01)
*G05G 1/08* (2006.01)
(Continued)

(52) U.S. Cl.
CPC ..... *F24C 3/124* (2013.01); *F24C 3/12* (2013.01); *F24C 7/08* (2013.01); *F24C 7/082* (2013.01);
(Continued)

(58) Field of Classification Search
CPC ..... G05G 1/08; G05G 1/082; G05G 1/10; G05G 1/12; F24C 3/122; F24C 3/124;
(Continued)

(56) References Cited

U.S. PATENT DOCUMENTS 2,501,008 A * 3/1950 Schramm ..... F16K 35/027 74/548
2,899,841 A * 8/1959 Melloy ..... G05G 1/12 74/548
(Continued)

FOREIGN PATENT DOCUMENTS

EP 0702381 A1 3/1996
JP H04195310 A 7/1992
(Continued)

OTHER PUBLICATIONS

International Search Report in connection with International Application No. PCT/KR2019/012419 dated Jan. 17, 2020, 3 pages.
(Continued)

*Primary Examiner* — Richard W Ridley
*Assistant Examiner* — Brian J McGovern

(57) ABSTRACT

A cooking appliance capable of preventing a user's unintended rotation of a knob assembly includes: a main body including a control panel; a valve positioned inside the main body, and including a valve shaft being pushable and rotatable; and a knob assembly including an inner knob coupled with the valve shaft, and an outer knob being movable with respect to the inner knob in a first direction in which the outer knob approaches the inner knob, wherein, when the outer knob moves by a first push distance in the first direction, the valve shaft and the inner knob are prevented from rotating.

18 Claims, 14 Drawing Sheets

(51) Int. Cl.
*F24C 7/08* (2006.01)
*G05G 5/00* (2006.01)
*G05G 1/10* (2006.01)

(52) U.S. Cl.
CPC ..... *G05G 1/082* (2013.01); *F24C 3/122* (2013.01); *F24C 3/126* (2013.01); *F24C 7/081* (2013.01); *G05G 1/08* (2013.01); *G05G 1/10* (2013.01); *G05G 5/005* (2013.01)

(58) Field of Classification Search
CPC .. F24C 3/126; F24C 7/08; F24C 7/081; F24C 7/082; H01H 25/06; H01H 3/20
See application file for complete search history.

(56) References Cited

U.S. PATENT DOCUMENTS 3,986,409 A * 10/1976 Tripp ..... G05G 1/02 74/548
4,532,817 A * 8/1985 Chaki ..... H03J 5/12 192/69.91
4,549,716 A * 10/1985 Warren ..... F16K 31/60 192/69.91
5,513,831 A * 5/1996 Seward ..... F16K 35/027 192/95
6,012,445 A 1/2000 Santelli, Jr.
7,285,738 B2 * 10/2007 Lavigne ..... H01H 3/08 200/18
7,479,607 B2 1/2009 Sack et al.
10,054,315 B2 8/2018 Choi
2017/0227231 A1 * 8/2017 Pionek ..... F24C 3/124
2017/0235328 A1 8/2017 Swayne et al.
2018/0238553 A1 8/2018 Ha

FOREIGN PATENT DOCUMENTS

JP 2004012063 A 1/2004
KR 1998-011998 U 5/1998
KR 100288946 B1 2/2001
KR 10-0942568 B1 2/2010
KR 101833340 B1 4/2018
WO 0150053 A1 7/2001

OTHER PUBLICATIONS

European Search Report in connection with European Application No. 19199925.9 dated Feb. 11, 2020, 7 pages.
Communication pursuant to Article 94(3) EPC dated Jun. 18, 2021 in connection with European Patent Application No. 19 199 925.9, 6 pages.

* cited by examiner

COOKING APPLIANCE

CROSS-REFERENCE TO RELATED APPLICATION

This application is based on and claims priority under 35 U.S.C. § 119 to Korean Patent Application No. 10-2018-0114916 filed on Sep. 27, 2018 in the Korean Intellectual Property Office, the disclosure of which is incorporated by reference herein in its entirety.

BACKGROUND

1. Field

The disclosure relates to a cooking appliance including a knob assembly used for operating the cooking appliance.

2. Description of the Related Art

In general, a cooking appliance is a home appliance including a cooking room, a heating apparatus for applying heat to the cooking room, and a circulating apparatus for circulating heat generated by the heating apparatus inside the cooking room to cook food.

The cooking appliance is an appliance for cooking food by sealing and heating the food. Cooking appliances are generally classified into an electric type, a gas type, and an electronic type according to their heat sources.

For example, an electric oven uses an electric heater as a heating source, and a gas oven and a microwave use heat generated by gas and frictional heat of water molecules caused by high frequency as heating sources, respectively.

The cooking appliance includes a control panel on any one of the front and top surfaces of the main body. In the control panel, a plurality of buttons, a key pad, a knob assembly, etc. configured to set a user's desired cooking mode or various conditions required for cooking are provided.

Particularly, when a knob assembly is provided on the control panel, a user turns the knob assembly to control an operation of the main body.

Generally, the knob assembly operates by a push to turn method due to the property of a valve that drives a heating source.

The user controls the operation of the main body through the knob assembly by a two-step mechanism of pushing the knob assembly to push the valve shaft of the valve and then turning the knob assembly.

However, when the user unintentionally pushes the knob assembly to turn it, a fire/burn may be caused. Accordingly, the cooking appliance needs to include a knob stopper for preventing an unintended operation of the knob assembly or a knob cap for opening and closing the knob assembly.

However, for a user to use the knob assembly, he/she needs to remove the knob stopper or open the knob cap. Therefore, the two-step mechanism changes to a three-step mechanism.

Furthermore, the knob stopper and the knob cap may deteriorate the entire design of the cooking appliance, and also, the knob stopper and the knob cap may be deformed by heat generated when the cooking appliance is used.

SUMMARY

Therefore, it is an aspect of the disclosure to provide a cooking appliance capable of preventing a user's unintended rotation of a knob assembly.

It is another aspect of the disclosure to provide a cooking appliance that increases a push distance of a knob to prevent a user's unintended rotation of a knob assembly.

It is another aspect of the disclosure to provide a cooking appliance including a knob assembly configured to rotate when an inner knob is pushed.

Additional aspects of the disclosure will be set forth in part in the description which follows and, in part, will be obvious from the description, or may be learned by practice of the disclosure.

In accordance with an aspect of the disclosure, a cooking appliance includes: a main body including a control panel; a valve positioned inside the main body, and including a valve shaft being pushable and rotatable; and a knob assembly including an inner knob coupled with the valve shaft, and an outer knob being movable in a first direction in which the outer knob approaches the inner knob, wherein, when the outer knob moves by a first push distance in the first direction, the valve shaft and the inner knob are prevented from rotating.

When the outer knob moves in the first direction by a second push distance that is longer than the first push distance, the valve shaft and the inner knob may be rotatable.

The first direction may be parallel to a direction in which the valve shaft extends.

The knob assembly may further include an elastic member positioned between the outer knob and the inner knob, When the outer knob moves in the first direction, the elastic member may provide an elastic force to move the outer knob in a second direction that is opposite to the first direction.

The elastic force of the elastic member may be smaller than a force required when the valve shaft is pushed in the first direction.

The outer knob may include a boss portion protruding toward the inner knob, wherein a screw thread may be formed in an inner surface of the boss portion.

The inner knob may include a hole being opposite to the boss portion, and a support surface positioned around the hole.

The knob assembly may further include a coupling member passed through the hole and screwed with the screw thread of the boss portion.

One end of the elastic member may be in contact with the boss portion, and the other end of the elastic member may be in contact with the support surface.

The coupling member may include a head portion having a diameter that is larger than a diameter of the hole.

The head portion may prevent the outer knob from being separated from the inner knob in the second direction that is opposite to the first direction.

In accordance with another aspect of the disclosure, a cooking appliance includes: a main body comprising a control panel; a valve positioned inside the main body, and including a valve shaft being pushable and rotatable; and a knob assembly including a knob coupled with the valve shaft and configured to push and rotate the valve shaft, and a cover knob covering the knob to prevent the knob from being pushed.

When the knob is pushed, the cover knob, the knob, and the valve shaft may be rotatable.

When the cover knob is pushed, the cover knob, the knob, and the valve shaft may be prevented from rotating.

The cover knob may include a boss protruding toward the knob, wherein a screw thread may be formed in an inner surface of the boss.

The knob may include a boss hole through which the boss passes.

The knob assembly may further include a coupling member screwed with the boss.

The coupling member may include a head portion having a diameter that is larger than a diameter of the boss hole.

The knob assembly may further include an elastic member positioned between the boss and the head portion.

When the knob is pushed in a first direction to push and rotate the valve shaft, the elastic member may provide an elastic force to move the knob in a second direction that is opposite to the first direction.

The cover knob may be pushable by a first distance, and the knob may be pushable by a second distance that is longer than the first distance.

When the cover knob is pushed by the first distance, the valve shaft may be prevented from rotating.

When the knob is pushed by the second distance, the valve shaft may be rotatable.

In accordance with another aspect of the disclosure, a cooking appliance includes: a valve body; a valve shaft being insertable in the valve body, and being rotatable with respect to the valve body when being inserted in the valve body; and a knob assembly coupled with the valve shaft and configured to insert the valve shaft in the valve body and rotate the valve shaft with respect to the valve body.

The knob assembly may include: an inner knob coupled with the valve shaft; and an outer knob being movable relative to the inner knob by a predetermined distance, wherein, when the outer knob moves by the predetermined distance in a direction in which the outer knob approaches the inner knob, the outer knob does not push the inner knob.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the illustrative embodiments of the disclosure, and thus it is to be understood that various modified examples, which may replace the embodiments and the drawings described in the present specification, are possible when filing the present application.

The terms used in the present specification are merely used to describe embodiments, and are not intended to limit the disclosure. An expression used in the singular encompasses the expression of the plural, unless it has a clearly different meaning in the context.

In the present specification, it is to be understood that the terms such as "comprising", "including" or "having", etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, a second component may be termed a first component without departing from the teachings of this disclosure.

In the following description, the terms "front direction", "rear direction", "upper portion" and "lower portion" are defined based on the drawings, and the shapes and positions of the corresponding components are not limited by the terms.

Hereinafter, the embodiments of the disclosure will be described in detail with reference to the accompanying drawings. Hereinafter, a cooking appliance according to an embodiment of the disclosure is an oven range including an oven, however, the embodiments of the disclosure may be applied to a cooking appliance including no oven.

Figure 1:
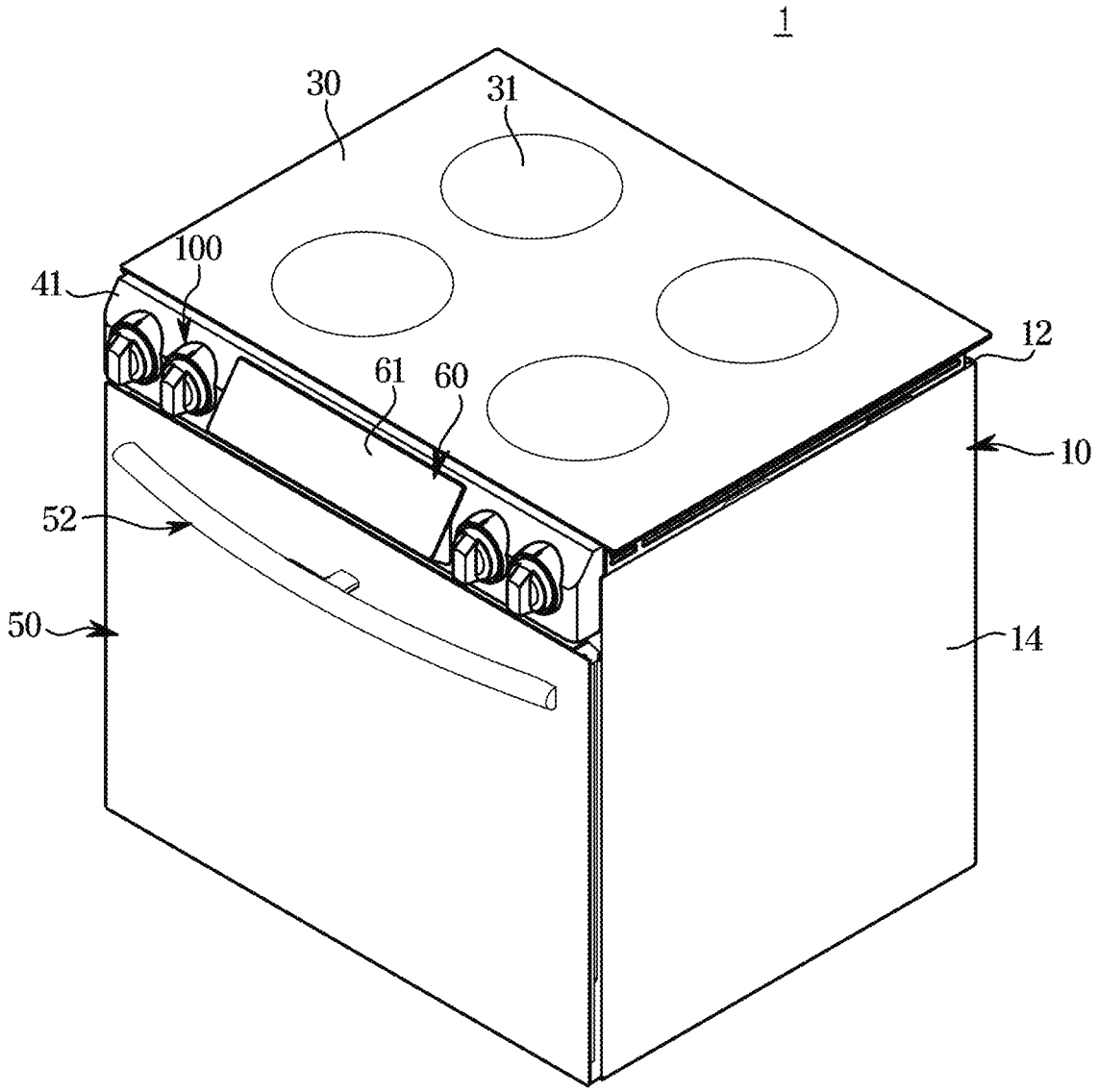
FIG. 1 illustrates a perspective view of a cooking appliance according to an embodiment of the disclosure.
Figure 2:
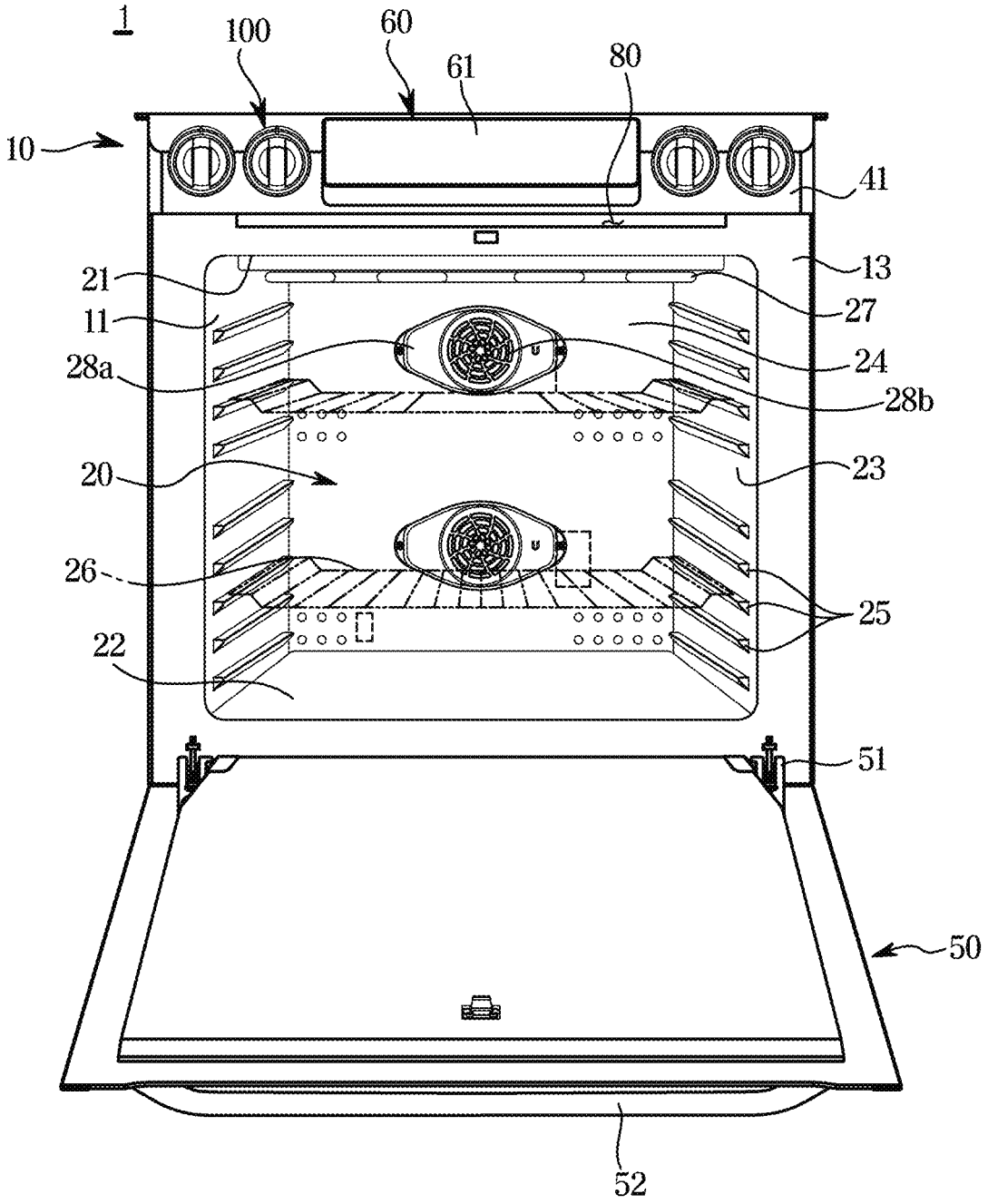
FIG. 2 shows a cooking appliance according to an embodiment of the disclosure when a door of the cooking appliance opens.
Figure 3:
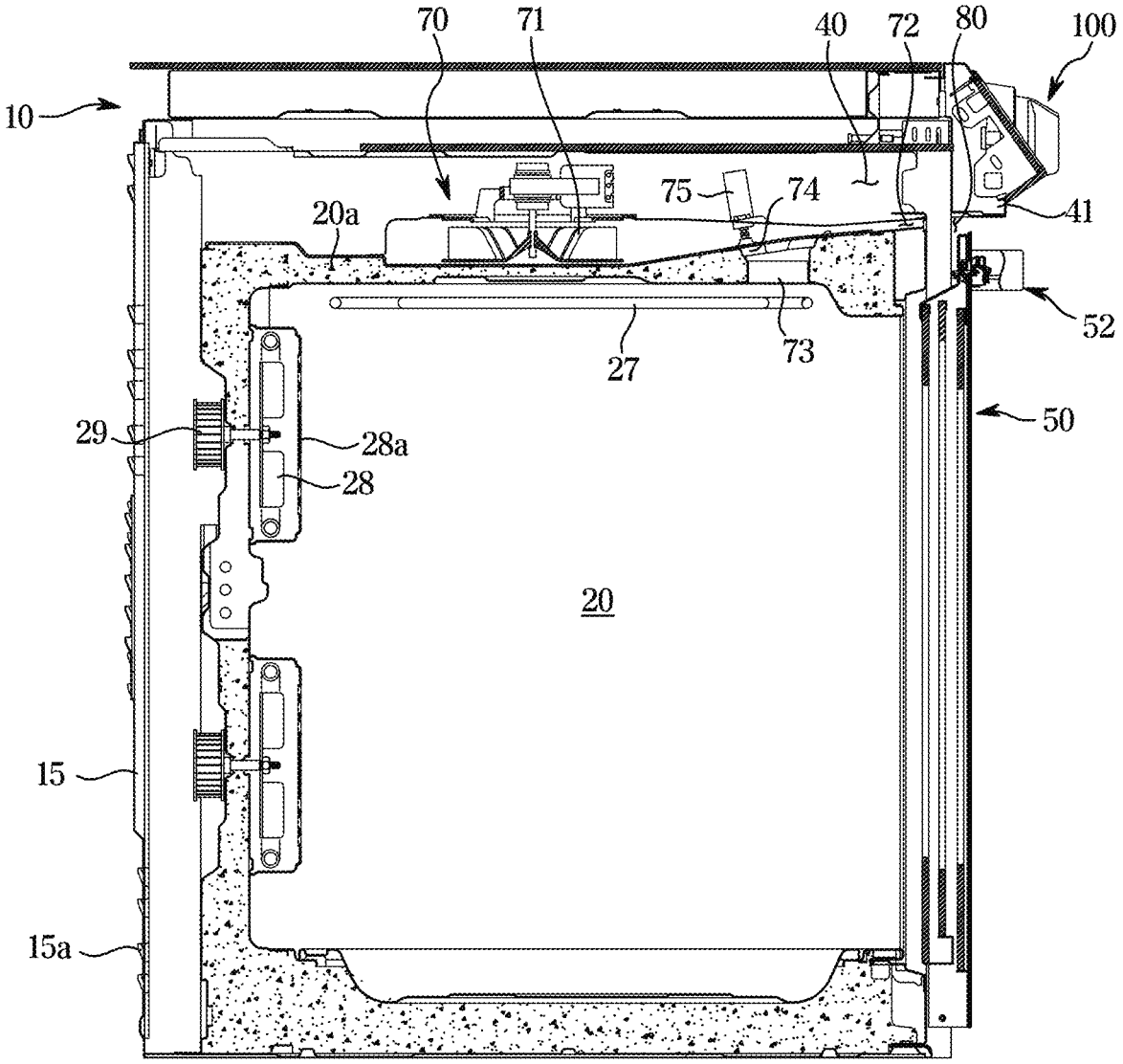
FIG. 3 illustrates a side cross-sectional view of a cooking appliance according to an embodiment of the disclosure.

FIG. 1 illustrates a perspective view of a cooking appliance according to an embodiment of the disclosure. FIG. 2 shows a cooking appliance according to an embodiment of the disclosure when a door of the cooking appliance opens. FIG. 3 illustrates a side cross-sectional view of a cooking appliance according to an embodiment of the disclosure.

As shown in FIGS. 1, 2, and 3, a cooking appliance 1 may include a main body 10 including an inner case 11 in which a cooking room 20 is formed and an outer case 12 coupled with an outer portion of the inner case 11 and forming an outer appearance of the cooking appliance 1.

The inner case 11 and the outer case 12 may be substantially in the shape of a box whose front side opens.

The cooking appliance 1 may include a cooktop 30 which is positioned on a top of the cooking appliance 1 and on which a container with food is put and heated. The cooktop 30 may include at least one heating portion 31. A container with food may be placed on the heating portion 31 to be heated directly.

The cooking appliance 1 may include a door 50 positioned on a front side of the main body 10 to open and close the cooking room 20.

The outer case 12 may include a front panel 13 forming the front side of the main body 10, side panels 14 forming lateral sides of the main body 10, and a rear panel 15 forming a rear side of the main body 10.

In the front panel 13, an opening may be formed, and by the opening, a front side of the cooking room 20 formed in the inside of the main body 10 may open. At an upper portion of a front surface of the front panel 13, a control panel 41 may be provided to cover a front side of a machine room 40. In the control panel 41, a display module 60 may be installed.

The control panel 41 may be positioned at at least one portion of the main body 10. According to an embodiment of the disclosure, the control panel 41 may be positioned at a side of the front surface of the main body 10, although not limited thereto. However, the control panel 41 may be positioned on a top surface of the main body 10 or form one side of the main body 10.

In the rear panel 15, an inlet 15*a* may be provided to inhale air into the machine room 40. Air inhaled in the machine room 40 through the inlet 15*a* may flow inside the machine room 40 to cool electrical components, although not limited thereto.

However, the inlet 15*a* may be located at any other position as long as the inlet 15*a* guides outside air to be inhaled into the machine room 40.

The cooking room 20 may be defined by a upper plate 21, a bottom plate 22, both side plates 23, and a rear plate 24. The cooking room 20 may be a cooking space, wherein the front side of the cooking room 20 opens through the opening of the front panel 13 to enable a user to put food in the cooking room 20 or take food out of the cooking room 20.

On inner surfaces of the side plates 23, a plurality of support bars 25 may be positioned. On the support bars 25, at least one removable rack 26 may be placed to put food thereon.

On the support bars 25, a rail (not shown) along which the rack 26 slides to move may be provided. The user may move the rack 26 through the rail (not shown) to take food from the rack 26 or put food on the rack 26.

On the support bars 25, a divider (not shown) for dividing the cooking room 20 into a plurality of cooking rooms 20 may be placed. The plurality of cooking rooms 20 divided by the divider may have not necessarily the same size. That is, the plurality of cooking rooms 20 may have different sizes.

Therefore, the user may use spaces of the cooking rooms 20 divided according to his/her intention in various ways. The divider may be formed of an insulating material to insulate the individual cooking rooms 20.

In the cooking room 20, a heater 27 for heating food may be provided, and the heater 27 may be an electric heater including an electric resistance element, although not limited thereto. However, the heater 27 may be a gas heater for burning gas to generate heat. Accordingly, the cooking appliance 1 may include an electric oven and a gas oven.

In the rear plate 24 of the cooking room 20, a circulating fan 28 for circulating air of the cooking room 20 to uniformly heat food and a circulating motor 29 for driving the circulating fan 28 may be installed.

A fan cover 28*a* may be positioned in front of the circulating fan 28 to cover the circulating fan 28. In the fan cover 28*a*, a discharge hole 28*b* may be formed to cause air to flow.

The open front side of the cooking room 20 may be opened or closed by the door 50, and the door 50 may be rotatably coupled with the main body 10 by a hinge 51 installed in a lower portion of the main body 10.

In a front upper portion of the door 50, a handle 52 may be provided which is gripped by the user for the door 50 to open or close the cooking room 20.

The display module 60 for displaying various operation information of the cooking appliance 1 and enabling the user to input an operation command may be positioned in the control panel 41 provided in the front upper portion of the front panel 13.

The display module 60 may include a liquid crystal display (LCD), and the LCD may display electrical information being a change of liquid crystal transmittance according to an applied voltage as visual information.

The LCD may include a liquid crystal module for displaying images and a light source unit for radiating light to the liquid crystal module. The light source unit may be a LED.

The display module 60 may include a cover panel 61 positioned on a front surface of the LCD. The cover panel 61 may be a protective panel for protecting the LCD or a touch panel capable of receiving a user's touch commands.

In the control panel 41, a knob assembly 100 for operating the cooking appliance 1 may be provided. According to an embodiment of the disclosure, four knob assemblies 100 may be provided, although not limited thereto. The knob assembly 100 will be described in detail, later.

An insulating material 20*a* for insulating the machine room 40 and the cooking room 20 may be positioned between the machine room 40 and the cooking room 20 to prevent hot air of the cooking room 20 from being transferred to the machine room 40.

The insulating material 20*a* may surround the entire of the cooking room 20, as well as between the machine room 40 and the cooking room 20, to prevent hot air of the cooking room 20 from being transferred to outside of the cooking appliance 1.

Because an inside temperature of the machine room 40 may rise by heat from various electrical components, a blow apparatus 70 for circulating air around the machine room 40 to cool the machine room 40 may be provided in the cooking appliance 1.

The blow apparatus 70 may include a blow fan 71 for blowing air, and a discharge flow path 72 for discharging air inhaled by the blow fan 71 toward a front side of the cooking appliance 1.

The blow fan 71 may inhale air in an axial direction and then discharge the air in a radial direction. That is, the blow fan 71 according to the disclosure may be a centrifugal fan. However, the blow fan 71 may be an axial flow fan.

Outside air may be inhaled into the machine room 40 through the inlet 15*a* positioned in the rear panel 15, and air inhaled in the machine room 40 may flow inside the machine room 40 to cool the electrical components and then flow along the discharge flow path 72 to be discharged in a front direction from the cooking appliance 1 through an outlet 80.

The outlet 80 may include a space between the front panel 13 and the control panel 41, although not limited thereto. However, the outlet 80 may be located at various positions and have various shapes, as long as the outlet 80 allows air inhaled through the inlet 15*a* to be discharged to the outside of the main body 10.

A part of inside air of the cooking room 20 may be inhaled in the discharge flow path 72 through a cooking room flow path 73 and discharged to the front side of the cooking appliance 1.

In the discharge flow path 72, a bypass hole 74 for allowing a part of air flowing from the discharge flow path 72 to the outlet 80 to flow to the cooking room flow path 73 may be formed. The bypass hole 74 may be opened or closed by an opening and closing device 75.

When the bypass hole 74 is opened and closed by the opening and closing device 75, an amount of air entering the cooking room flow path 73 among air flowing from the discharge flow path 72 to the outlet 80 may be adjusted. Therefore, an emission amount of air that is discharged from the cooking room 20 to the cooking room flow path 73 may be adjusted.

The door 50 rotatably coupled with the front side of the main body 10 to open or close the cooking room 20 may be a plurality of doors. The door 50 may be configured with a plurality of glass plates.

Figure 4:
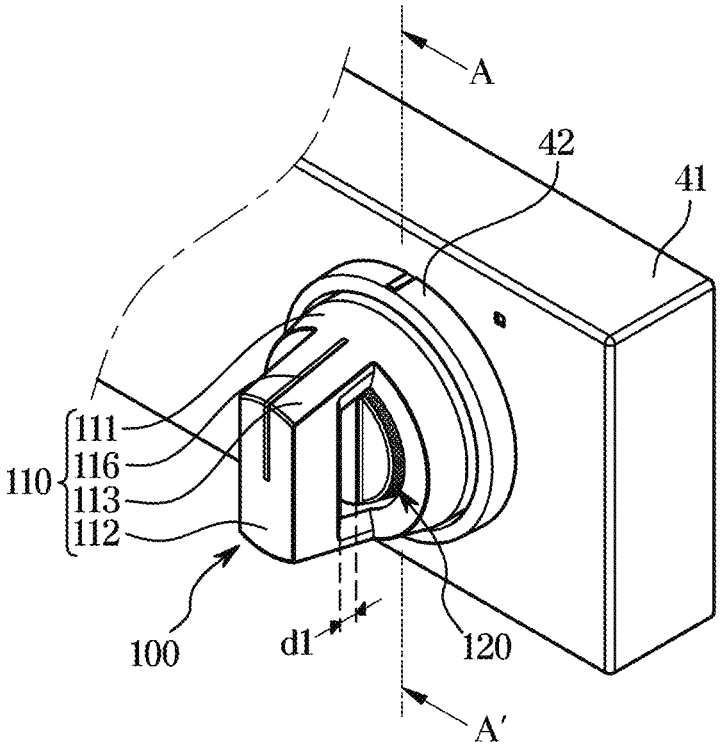
FIG. 4 illustrates a perspective view of a knob assembly positioned in a control panel in a cooking appliance according to an embodiment of the disclosure.
Figure 5:
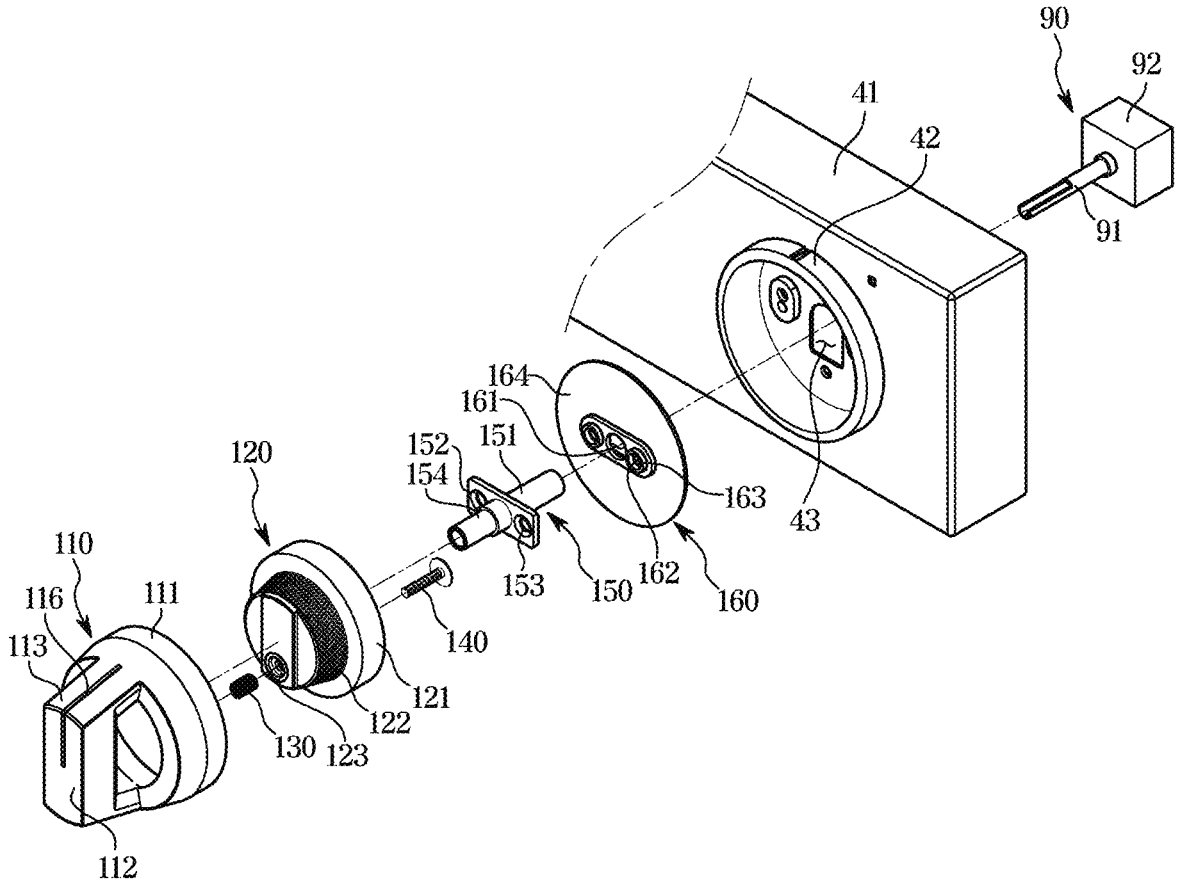
FIG. 5 illustrates an exploded perspective view of a knob assembly positioned in a control panel in a cooking appliance according to an embodiment of the disclosure.

FIG. 4 illustrates a perspective view of a knob assembly positioned in a control panel in a cooking appliance according to an embodiment of the disclosure. FIG. 5 illustrates an exploded perspective view of a knob assembly positioned in a control panel in a cooking appliance according to an embodiment of the disclosure.

As shown in FIGS. 4 and 5, the cooking appliance 1 according to an embodiment of the disclosure may include a valve 90 installed inside the main body 10. The valve 90 may include a control module 92, and a valve shaft 91 that is able to be inserted in the control module 92. In other words, the valve shaft 91 may be coupled with the control module 92 in such a way to be able to be pushed into the control module 92.

The control module 92 may control a heating source (not shown) of the cooking appliance 1. The valve shaft 91 may be coupled with the control module 92 in such a way to be able to be pushed into the control module 92 and rotate with respect to the control module 92. The valve shaft 91 may be coupled with the control module 92 in such a way to be rotatable with respect to the control module 92. However, when the valve shaft 91 is not pushed into the control module 92, the valve shaft 91 may be prevented from rotating. When the valve shaft 91 is pushed into the control module 92 and rotates with respect to the control module 92, the control module 92 may control an operation of the heating source (not shown).

The control module 92 may receive signal about a degree of rotation of the valve shaft 91 to control the heating source. For example, the control module 92 may control an on/off operation, a temperature, etc. of the heating portion 31 (see FIG. 1) of the cooktop 30 (see FIG. 1), and control an on/off operation, a temperature, a cooking time, a cooking mode, etc. of the heater 27 (see FIG. 2).

The cooking appliance 1 may include the knob assembly 100 positioned in the control panel 41 to adjust an amount of opening and closing of the valve 90. The knob assembly 100 may push and rotate the valve shaft 91 to open the valve 90. An interior of the control panel 41 can include a receiving portion 43 to receive the valve shaft 91.

The knob assembly 100 may include an outer knob 110 and an inner knob 120. The outer knob 110 may be spaced a first push distance d1 from the inner knob 120. The outer knob 110 may cover the inner knob 120. However, the outer knob 110 may include an opening so that a portion of the inner knob 120 is exposed to outside. An exterior of the control panel 41 can include a raised enclosure 42 to surround the outer knob 110.

The outer knob 110 may include an outer knob body 111 being substantially in the shape of a donut, a grip portion 112 spaced a predetermined distance from the outer knob body 111, and a connecting portion 113 connecting the outer knob body 111 with the grip portion 112. Also, the outer knob 110 may include a light emitting portion 116. The light emitting portion 116 may irradiate light according to whether or not the valve 90 opens. The light emitting portion 116 may be positioned over the grip portion 112 and the connecting portion 113.

The knob assembly 100 may include a first elastic member 130 positioned between the outer knob 110 and the inner knob 120 to provide an elastic force, and a first coupling member 140 locating the first elastic member 130 between the outer knob 110 and the inner knob 120. Also, the knob assembly 100 may include a shaft coupling portion 150 coupled with the inner knob 120 and the valve shaft 91, and a knob base 160 including a washer 164 that covers a bottom surface of the knob assembly 100.

The inner knob 120 may include an inner knob body 121 being substantially in the shape of a cylinder, and a protrusion 122 protruding toward the outer knob 110 from the inner knob body 121 and having a smaller diameter than the inner knob body 121. A side surface of the protrusion 122 may be processed to increase a friction force. The processing of the side surface of the protrusion 122 may be to prevent slipping when a user grips the protrusion 122 and rotates the knob assembly 100, although not limited thereto. However, the side surface of the protrusion 122 may be a smooth surface.

In an upper surface of the protrusion 122, a resting portion 123 on which the first elastic member 130 is rested may be formed. The upper surface of the protrusion 122 may be one surface of the protrusion 122 being opposite to the outer knob 110. In the resting portion 123, a coupling hole 124 (see FIG. 6) through which the first coupling member 140 passes may be formed.

The shaft coupling portion 150 may include a shaft insertion portion 151 in which the valve shaft 91 is inserted, and a knob coupling portion 154 coupled with the inner knob 120. The shaft insertion portion 151 may be formed at one end of the shaft coupling portion 150, and the knob coupling portion 154 may be formed at the other end of the shaft coupling portion 150. Also, the shaft coupling portion 150 may include a base coupling portion 152 coupled with the knob base 160 and a base coupling hole 153 formed in the base coupling portion 152.

The knob base 160 may include a shaft hole 161 through which the valve shaft 91 passes, a base hole 162 formed at a location corresponding to the base coupling hole 153, and a base rib 163 formed around the base hole 162.

Figure 6:
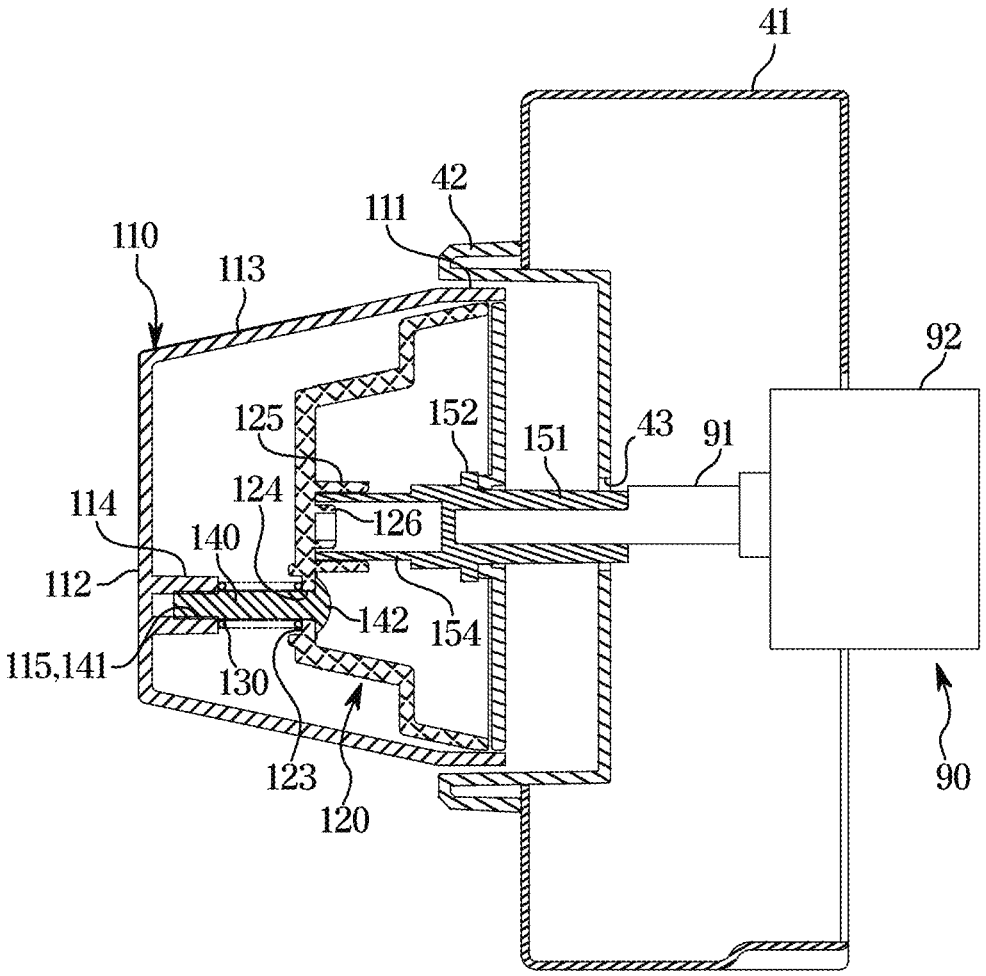
FIG. 6 illustrates a side cross-sectional view of a knob assembly and a control panel, cut along line A-A' of FIG. 4.
Figure 7:
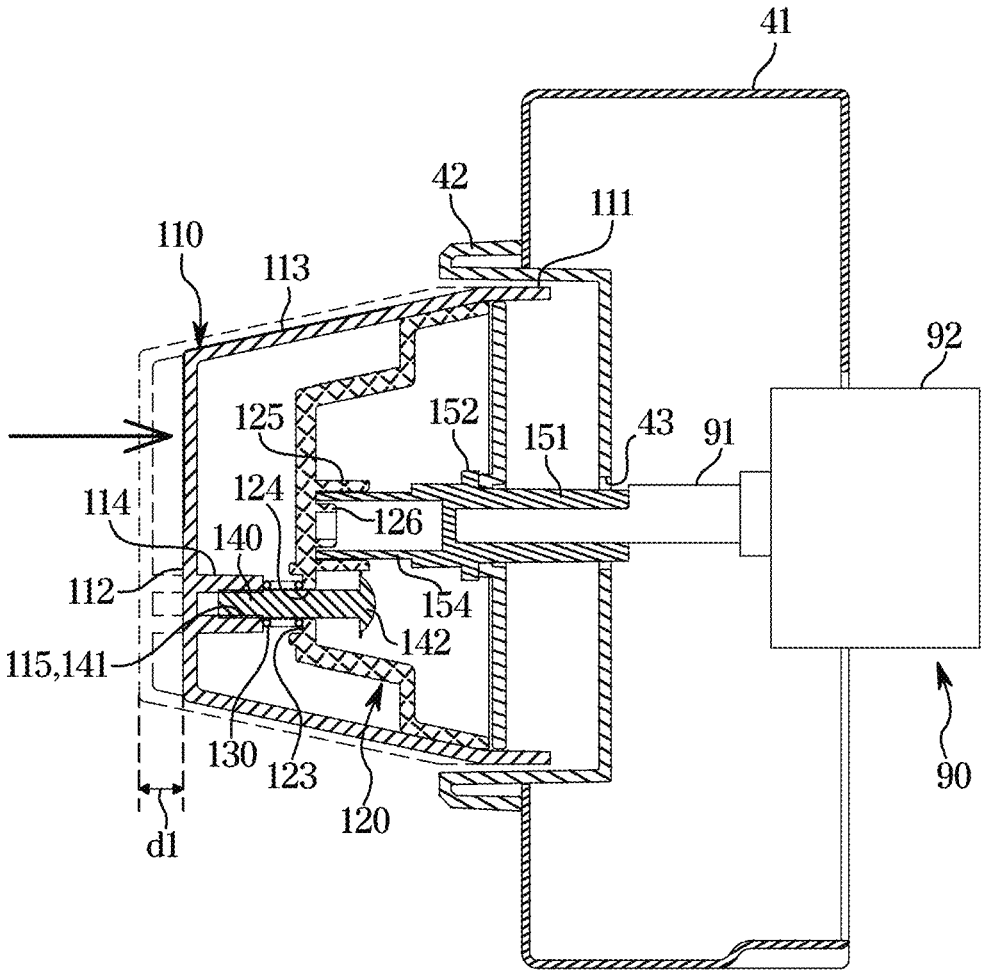
FIG. 7 illustrates a side cross-sectional view of a knob assembly and a control panel when an outer knob is pushed by a first push distance.
Figure 8:
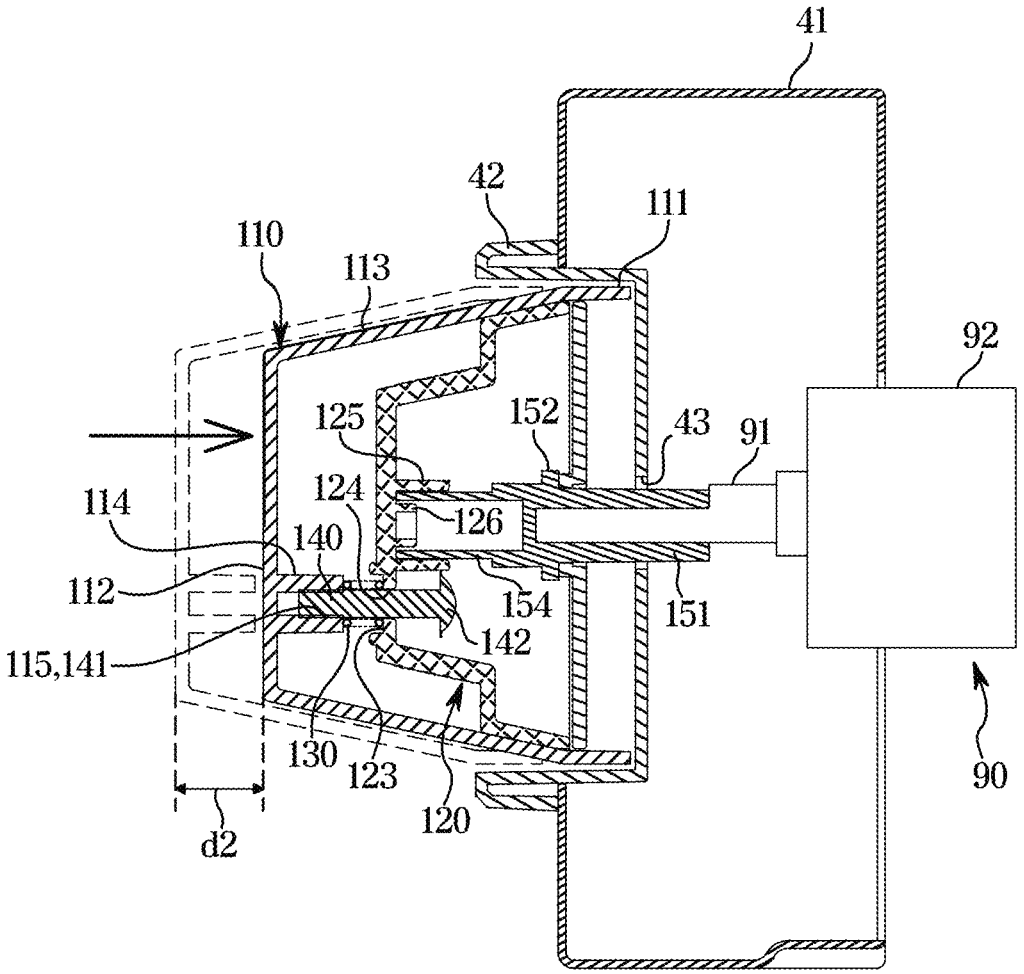
FIG. 8 illustrates a side cross-sectional view of a knob assembly and a control panel when an outer knob is pushed by a second push distance.

FIG. 6 illustrates a side cross-sectional view of a knob assembly and a control panel, cut along line A-A' of FIG. 4. FIG. 7 illustrates a side cross-sectional view of a knob assembly and a control panel when an outer knob is pushed by a first push distance. FIG. 8 illustrates a side cross-sectional view of a knob assembly and a control panel when an outer knob is pushed by a second push distance.

Hereinafter, an operation of the knob assembly 100 according to an embodiment of the disclosure will be described in detail with reference to FIGS. 6, 7, and 8. Also, an internal coupling structure of the knob assembly 100 will be described in detail.

As shown in FIGS. 4 and 6, the outer knob 110 may be spaced the first push distance d1 from the inner knob 120.

The outer knob 110 may include a boss portion 114 protruding toward the inner knob 120. In an inner surface of the boss portion 114, a screw thread 115 may be formed. The inner knob 120 may include the coupling hole 124 in which the first coupling member 140 is inserted. The coupling hole 124 may be opposite to the boss portion 114.

The first coupling member 140 may include a body portion having a screw thread 141 formed on the outer surface and having a smaller diameter than that of the coupling hole 124 such that the body portion passes through the coupling hole 124, and a head portion 142 having a larger diameter than that of the coupling hole 124. A portion of the body portion may be screwed with the boss portion 114. The first elastic member 130 may be positioned between the boss portion 114 and the resting portion 123. One end of the first elastic member 130 may be in contact with the boss portion 114, and the other end of the first elastic member 130 may be in contact with the resting portion 123. The first elastic member 130 may be a compression spring.

Because the diameter of the head portion 142 is larger than that of the coupling hole 124 and the body portion of the coupling member 140 is screwed with the boss portion 114, the outer knob 110 may be not separated from the inner knob 120. Also, the elastic member 130 may be not separated from the boss portion 114 and the resting portion 123.

The elastic member 130 may provide an elastic force in a direction in which the outer knob 110 moves away from the inner knob 120. The elastic member 130 may elastically bias the outer knob 110 in a direction in which the outer knob 110 moves away from the inner knob 120. By the elastic force of the elastic member 130, the outer knob 110 may be spaced the predetermined distance d1 from the inner knob 120.

The inner knob 120 may include ribs 125 and 126 coupled with the knob coupling portion 154. The ribs 125 and 126 may include a first rib 125 and a second rib 126 positioned inside the first rib 125. The knob coupling portion 154 may be inserted between the first rib 125 and the second rib 126.

Referring to FIG. 7, when a user pushes the outer knob 110, the outer knob 110 may be pushed by the first push distance d1.

The elastic force of the elastic member 130 may be smaller than a force required when the valve shaft 91 is inserted into the control module 92. Accordingly, although the elastic member 130 is compressed, the valve shaft 91 may be not inserted into the control module 92. When the outer knob 110 is pushed by the first push distance d1, the valve shaft 91 may be not inserted into the control module 92, and the valve shaft 91 and the inner knob 120 may be prevented from rotating.

According to a concept of the disclosure, although the outer knob 110 is pushed by the first push distance d1, the inner knob 120 and the valve shaft 91 may be not inserted in the control module, and the inner knob 120 and the valve shaft 91 may be prevented from rotating. The first push distance d1 may function as a preliminary push distance. Accordingly, when the user accidentally pushes the outer knob 110 by a predetermined distance, for example, by the first push distance d1, the knob assembly 100 may be prevented from rotating. Accordingly, accidents in which a fire or a user's burn occurs due to the user's unintended rotation of the knob assembly 100 causing an operation of the heating source may be prevented in advance. In other words, the knob assembly 100 according to an embodiment of the disclosure may increase a push distance of the knob for operating the heating source to thereby prevent a user's unintended rotation of the knob.

Referring to FIG. 8, after the outer knob 110 is pushed by the first push distance d1, the outer knob 110 may be further pushed by a second push distance d2.

When the outer knob 110 is pushed by the first push distance d1 and the second push distance d2, the inner knob 120 and the valve shaft 91 may be pushed by the second push distance d2 together with the outer knob 110.

When the inner knob 120 and the valve shaft 91 are pushed by the second push distance d2, the inner knob 120 and the valve shaft 91 may be rotatable to open the valve 90 and operate the heating source.

As described above, the knob assembly 100 according to an embodiment of the disclosure may increase the push distance of the knob to prevent a user's unintended rotation of the knob. More specifically, by increasing the push distance by the first push distance d1 which is a preliminary push distance, safety accidents such as a fire/burn may be prevented in advance.

Figure 9:
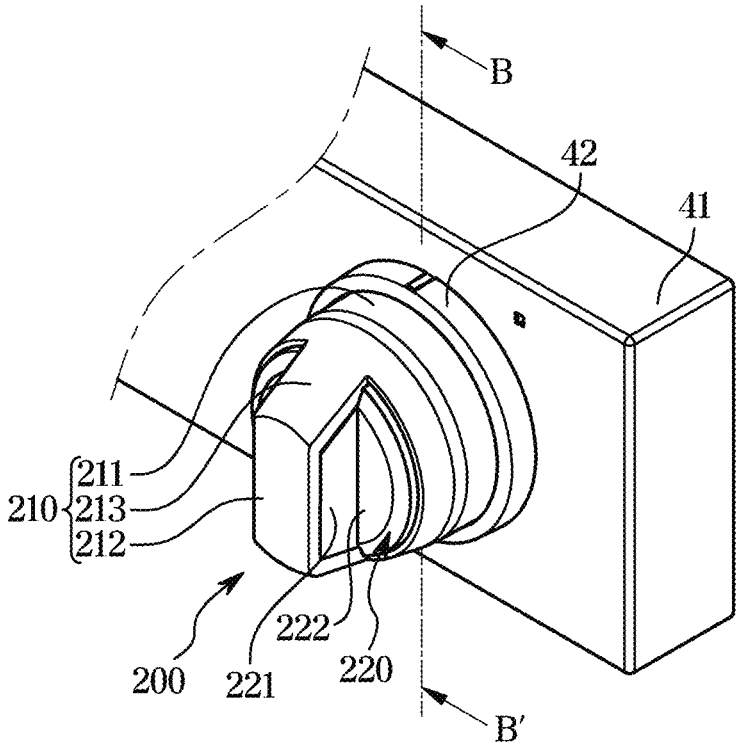
FIG. 9 illustrates a perspective view of a knob assembly positioned in a control panel in a cooking appliance according to another embodiment of the disclosure.
Figure 10:
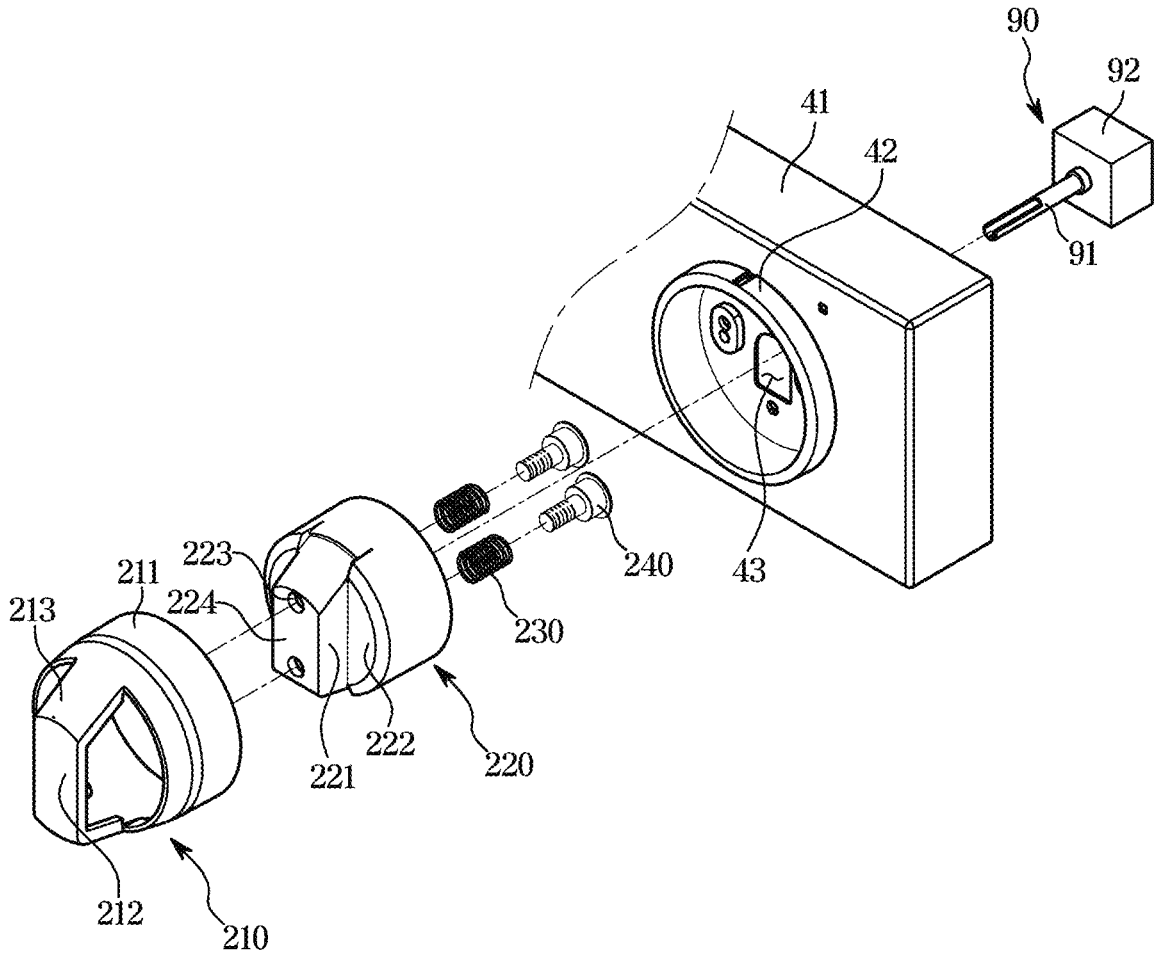
FIG. 10 illustrates an exploded perspective view of a knob assembly positioned in a control panel in a cooking appliance according to another embodiment of the disclosure.

FIG. 9 illustrates a perspective view of a knob assembly positioned in a control panel in a cooking appliance according to another embodiment of the disclosure. FIG. 10 illustrates an exploded perspective view of a knob assembly positioned in a control panel in a cooking appliance according to another embodiment of the disclosure.

Referring to FIGS. 9 and 10, a cooking appliance according to another embodiment of the disclosure may include a knob assembly 200 positioned in the control panel 41.

The knob assembly 200 may include a cover knob 210, and a knob 220 positioned inside the cover knob 210 and coupled with the valve shaft 91. Also, the knob assembly 200 may include a second elastic member 230 and a second coupling member 240.

The cover knob 210 may include a cover knob body 211 formed in the shape of a cylinder whose top and bottom sides open, a cover portion 212 spaced from the cover knob body 211, and a cover connecting portion 213 connecting the cover knob body 211 with the cover portion 212. The cover portion 212 may have a smaller area than that of the top side of the cover knob 210, and therefore, the cover knob 210 may include an open area.

The knob 220 may be coupled with an inner portion of the cover knob 210. The knob 220 may include grip surfaces 221 and 222 which a user grips. The grip surfaces 221 and 222 may include a first grip surface 221 and a second grip surface 222 that are perpendicular to each other. A top surface 224 of the knob 220 may protrude from the second grip surface 222 toward the cover knob 210. The top surface 224 of the knob 220 may be opposite to the cover portion 212 of the cover knob 210. In the top surface 224 of the knob 220, a boss hole 223 may be formed.

Figure 11:
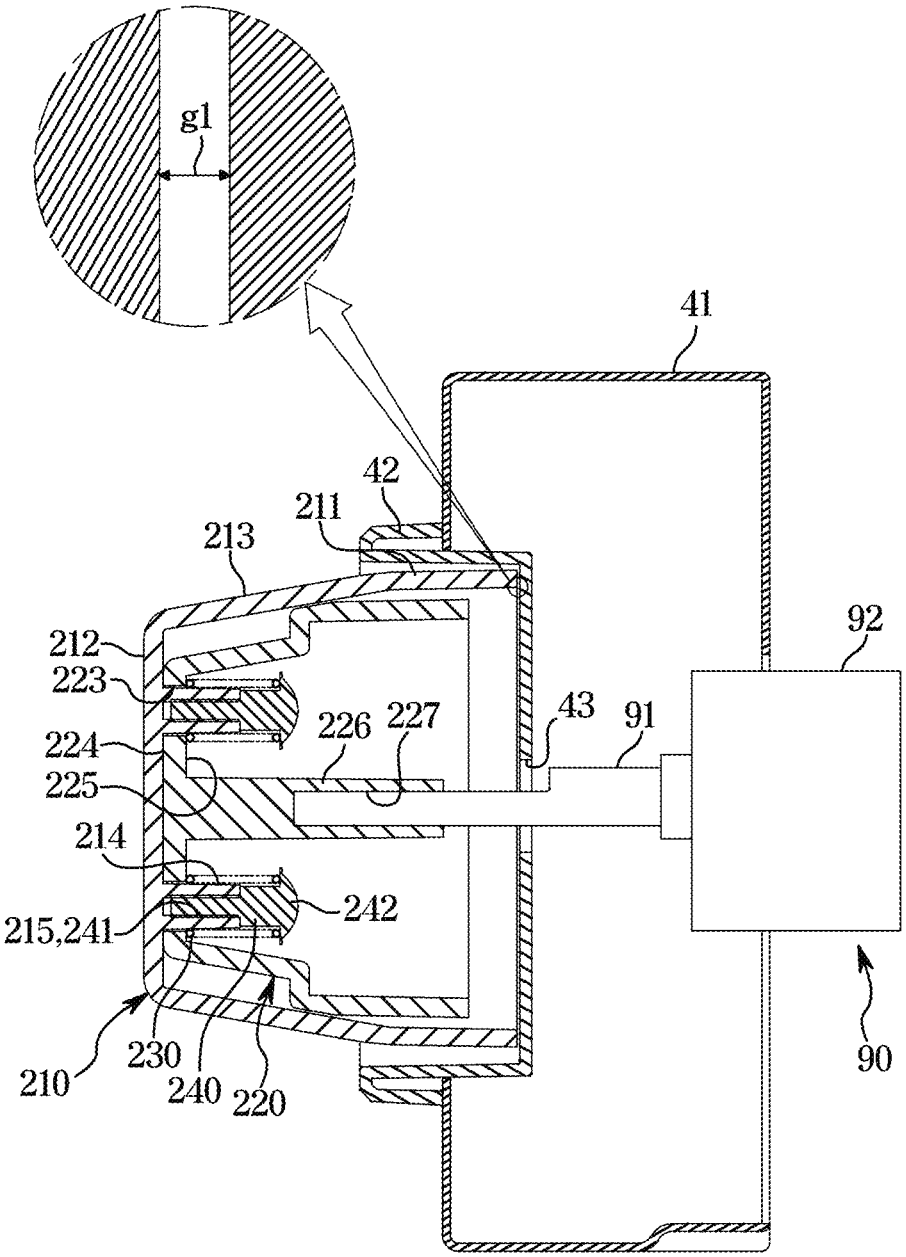
FIG. 11 illustrates a side cross-sectional view of a knob assembly and a control panel, cut along line B-B' of FIG. 9.
Figure 12:
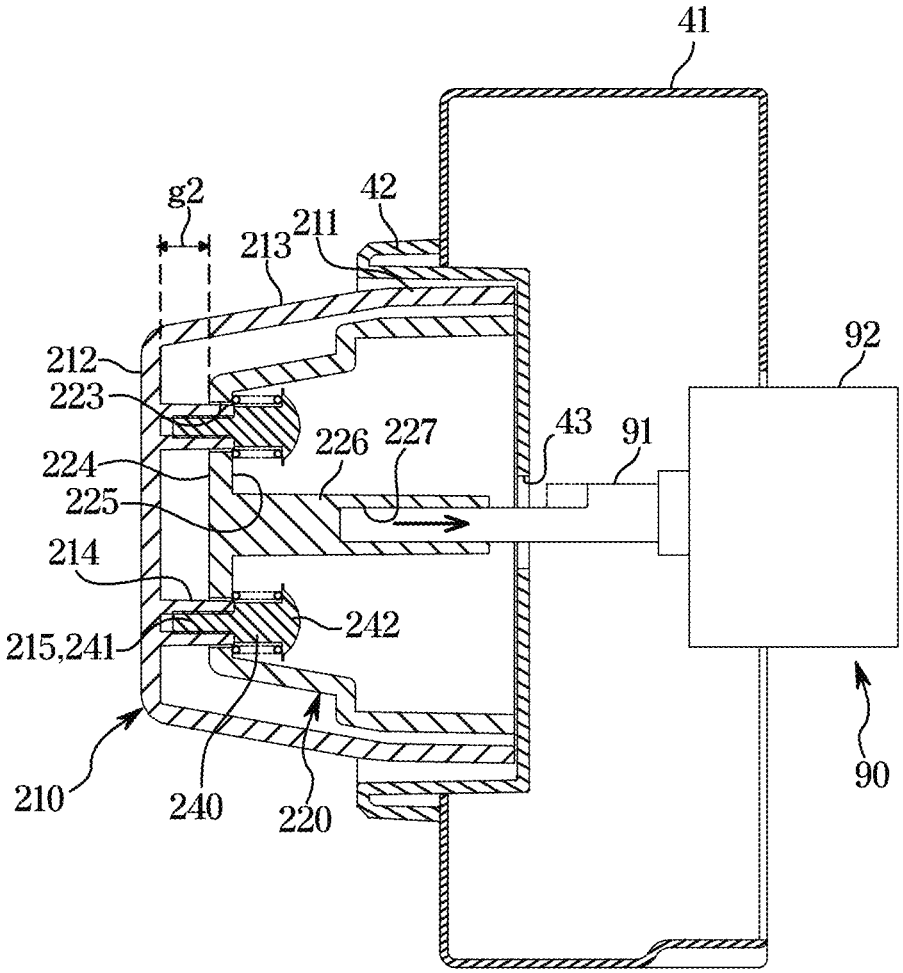
FIG. 12 illustrates a side cross-sectional view of a knob assembly and a control panel when an inner knob is pushed.

FIG. 11 illustrates a side cross-sectional view of a knob assembly and a control panel, cut along line B-B' of FIG. 9. FIG. 12 illustrates a side cross-sectional view of a knob assembly and a control panel when an inner knob is pushed.

Hereinafter, a structure of the knob assembly 200 according to another embodiment of the disclosure will be described in detail with reference to FIGS. 11 and 12. Also, an operation of the knob assembly 200 according to another embodiment of the disclosure will be described in detail.

The cover knob 210 may include a boss 214 protruding toward the knob 220. In an inner surface of the boss 214, a screw thread 215 may be formed.

The knob 220 may include a boss hole 223 into which the boss 214 is inserted. The boss 214 may move relative to the boss hole 223.

A second coupling member 240 may be screwed with the boss 214. The second coupling member 240 may include a body portion on which a screw thread 241 is formed, and a head portion 242 having a larger diameter than that of the boss hole 223.

The second elastic member 230 may be positioned between an outer circumference of the boss hole 223 and the head portion 242. The second elastic member 230 may provide an elastic force for causing the knob 220 to be in contact with the cover knob 210. The second elastic member 230 may provide an elastic force for causing the knob 220 to approach the cover knob 210. The second elastic member 230 may be a compression spring.

The knob 220 may include a valve boss 226 coupled with the valve shaft 91. The valve shaft 91 may be inserted in a boss groove 227 formed in the valve boss 226 at an opposite end of the valve boss 226 from a head portion 225.

Referring to FIGS. 11 and 12, the knob 220 may be in contact with the cover knob 210. The second elastic member 230 may provide an elastic force for causing the knob 220 to be in contact with the cover knob 210.

When a user pushes the cover knob 210, the cover knob 210 may be pushed by a first distance g1. When the cover knob 210 is pushed by the first distance g1, the knob 220 and the valve shaft 91 may be prevented from rotating. In other words, although the cover knob 210 is pushed by the first distance g1, the knob 210 and the valve shaft 91 may be not pushed until the valve 90 opens. Accordingly, although the user pushes the cover knob 210, the knob assembly 200 may be prevented from rotating.

The knob assembly 200 according to another embodiment of the disclosure may include the cover knob 210, and may not operate the heating source although the user pushes the cover knob 210. Accordingly, when the user pushes the cover knob 210 by mistake, the knob assembly 200 may be prevented from rotating, so that a fire and burn that may be caused by an unintended rotation of the knob assembly 200 may be prevented.

As shown in FIG. 12, when the user pushes the knob 220 by a second distance g2, the knob 220 and the valve shaft 91 may be rotatable. When the user pushes the knob 220 by the second distance g2, the valve shaft 91 coupled with the knob 220 may be inserted in the control module 92, so that the valve 90 may open. Accordingly, the knob assembly 200 may become a rotatable state.

According to another embodiment of the disclosure, when the cover knob 210 is pushed, the knob assembly 200 may be prevented from rotating, whereas, when the knob 220 is pushed, the knob assembly 200 may be allowed to rotate. Because pushing the knob 220 is safely determined as a user's intention to operate the heating source, the knob assembly 200 may be rotatable when the knob 220 is pushed.

The second elastic member 230 may provide an elastic force for causing the knob 220 to be in contact with the cover knob 210 when a user does not push the knob 220. The second elastic member 230 may provide an elastic force to move the knob 220 to its original position.

Figure 13:
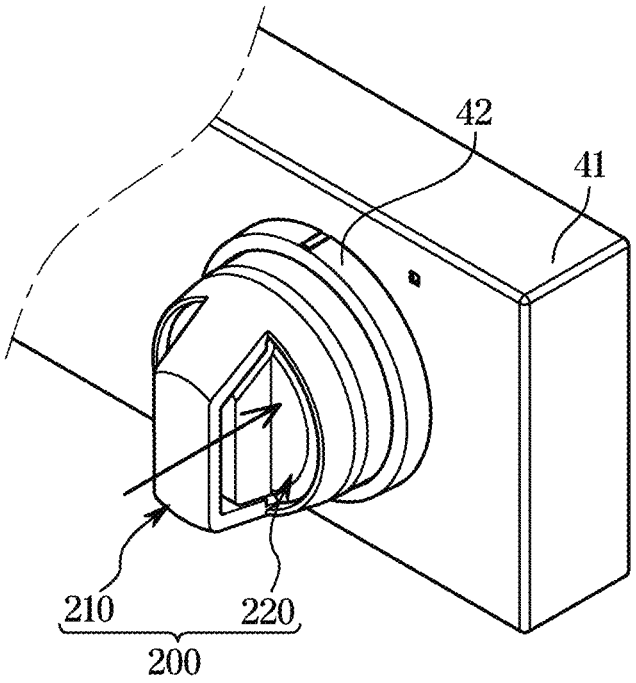
FIGS. 13 and 14 show an operation of a knob assembly in a cooking appliance according to another embodiment of the disclosure.
Figure 14:
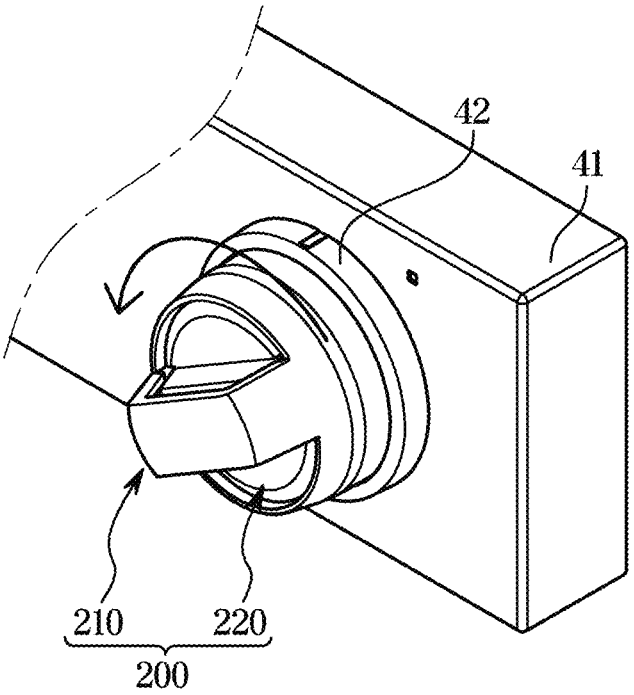

FIGS. 13 and 14 show an operation of a knob assembly in a cooking appliance according to another embodiment of the disclosure.

Referring to FIGS. 13 and 14, the knob assembly 200 according to another embodiment of the disclosure may be rotatable when the knob 220 is pushed. Although not shown in the drawings, when the cover knob 210 is pushed, the knob assembly 200 may be prevented from rotating. Accordingly, safety accidents in which a fire or a user's burn occurs due to the user's unintended rotation of the knob assembly 100 causing an operation of the heating source may be prevented in advance.

According to a concept of the disclosure, the cooking appliance capable of preventing a user's unintended rotation of the knob assembly may be provided.

According to another concept of the disclosure, the cooking appliance that increases a push distance of the knob to prevent a user's unintended rotation of the knob assembly may be provided.

According to another concept of the disclosure, the cooking appliance including the knob assembly being rotatable when the inner knob is pushed may be provided.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking appliance comprising:
a main body comprising a control panel;
a valve positioned inside the main body and comprising a valve shaft being pushable and rotatable; and
a knob assembly comprising:
an inner knob coupled with the valve shaft, and
an outer knob being movable in a first direction in which the outer knob approaches the inner knob, the outer knob comprises a threaded boss portion protruding from a top interior surface of the outer knob toward the inner knob,
wherein, based on the outer knob moving by a first push distance in the first direction, the valve shaft and the inner knob are prevented from rotating.

2. The cooking appliance of claim 1, wherein, based on the outer knob moving in the first direction by a second push distance that is longer than the first push distance, the valve shaft and the inner knob are rotatable.

3. The cooking appliance of claim 1, wherein the first direction is parallel to a direction in which the valve shaft extends.

4. The cooking appliance of claim 1, wherein:
the knob assembly further comprises an elastic member positioned between the outer knob and the inner knob, and based on the outer knob moving in the first direction, the elastic member provides an elastic force to move the outer knob in a second direction that is opposite to the first direction.

5. The cooking appliance of claim 4, wherein the elastic force of the elastic member is smaller than a force required when the valve shaft is pushed in the first direction.

6. The cooking appliance of claim 4, wherein the inner knob comprises:

a hole opposite the threaded boss portion; and a support surface positioned around the hole.

7. The cooking appliance of claim 6, wherein the knob assembly further comprises a coupling member passed through the hole and screwed with the threaded boss portion.

8. The cooking appliance of claim 7, wherein one end of the elastic member is in contact with the threaded boss portion and the other end of the elastic member is in contact with the support surface.

9. The cooking appliance of claim 7, wherein:

the coupling member comprises a head portion including a diameter that is larger than a diameter of the hole, and the head portion prevents the outer knob from being separated from the inner knob in the second direction that is opposite to the first direction.

10. A cooking appliance comprising:

a main body comprising a control panel;

a valve positioned inside the main body and comprising a valve shaft being pushable and rotatable; and a knob assembly comprising:

a knob coupled with the valve shaft and configured to push and rotate the valve shaft, and a cover knob covering the knob to prevent the knob from being pushed, wherein the cover knob comprises a boss protruding toward the knob, wherein the boss comprises a screw thread formed in an inner surface of the boss, and wherein the knob comprises a boss hole through which the boss passes.

11. The cooking appliance of claim 10, wherein, based on the knob is pushed, the cover knob, the knob, and the valve shaft are rotatable.

12. The cooking appliance of claim 10, wherein, based on the cover knob is pushed, the cover knob, the knob, and the valve shaft are prevented from rotating.

13. The cooking appliance of claim 10, wherein:

the knob assembly further comprises a coupling member screwed with the boss; and the coupling member comprises a head portion including a diameter that is larger than a diameter of the boss hole.

14. The cooking appliance of claim 13, wherein:

the knob assembly further comprises an elastic member positioned between the boss and the head portion, and based on the knob being pushed in a first direction to push and rotate the valve shaft, the elastic member provides an elastic force to move the knob in a second direction that is opposite to the first direction.

15. The cooking appliance of claim 10, wherein:

the cover knob is pushable by a first distance; and the knob is pushable by a second distance that is longer than the first distance.

16. The cooking appliance of claim 15, wherein, based on the cover knob being pushed by the first distance, the valve shaft is prevented from rotating.

17. The cooking appliance of claim 15, wherein, based on the knob being pushed by the second distance, the valve shaft is rotatable.

18. A cooking appliance comprising:

a valve body;

a valve shaft being insertable in the valve body and being rotatable with respect to the valve body when being inserted in the valve body; and a knob assembly coupled with the valve shaft and configured to insert the valve shaft in the valve body and rotate the valve shaft with respect to the valve body, the knob assembly comprising:

an inner knob coupled with the valve shaft; and an outer knob movable relative to the inner knob by a first distance, wherein, based on the outer knob moving by less than the predetermined first distance in a direction in which the outer knob approaches the inner knob, the outer knob does not push the inner knob, wherein subsequent to the outer knob moving the first distance in the direction in which the outer knob approaches the inner knob, the outer knob is movable a second distance in order to enable rotation of the valve shaft, the second distance being greater than the first distance.

* * * * *